US010315101B1

(12) United States Patent
Danner

(10) Patent No.: US 10,315,101 B1
(45) Date of Patent: Jun. 11, 2019

(54) SPRING-LOADED BILLIARD CUE ASSEMBLY

(71) Applicant: Prentice Danner, Memphis, IN (US)

(72) Inventor: Prentice Danner, Memphis, IN (US)

( * ) Notice: Subject to any disclaimer, the term of this patent is extended or adjusted under 35 U.S.C. 154(b) by 0 days.

(21) Appl. No.: 15/902,054

(22) Filed: Feb. 22, 2018

(51) Int. Cl.
*A63D 15/08* (2006.01)

(52) U.S. Cl.
CPC ..... *A63D 15/083* (2013.01)

(58) Field of Classification Search
CPC ..... A63D 15/083
USPC ..... 473/44–51
See application file for complete search history.

(56) References Cited

U.S. PATENT DOCUMENTS 3,246,895 A 4/1966 Traill
3,447,805 A 6/1969 Baley, Jr.
3,495,826 A 2/1970 Mizgala
4,134,588 A * 1/1979 Di Luzio ..... A63D 15/083 124/38
4,526,370 A * 7/1985 Mortellacci ..... A63D 15/083 473/45
4,634,123 A * 1/1987 Cowan ..... A63D 15/083 473/45
5,181,718 A * 1/1993 Valentine ..... A63D 3/02 124/16
5,275,398 A * 1/1994 Compton ..... A63D 15/083 473/2
5,299,983 A 4/1994 Pfost et al.
D391,327 S 2/1998 Golz
6,645,081 B1 11/2003 Salas
7,217,196 B2 * 5/2007 Cestro ..... A63D 15/083 473/45
2004/0077428 A1 4/2004 Oliver et al.

* cited by examiner

*Primary Examiner* — Mark S Graham

(57) ABSTRACT

A spring-loaded billiard cue assembly for shooting cue ball in billiards includes a tube that may be gripped while playing the game of billiards. A rod is slidably positioned in the tube and the rod is urged into a retracted position having the rod being positioned in the tube. The rod is biased into an extended position having the rod extending outwardly from the tube for striking a cue ball in the game of billiards. A light emitter is coupled to the tube to emit a beam of light outwardly therefrom for aiming during the game of billiards.

8 Claims, 7 Drawing Sheets

SPRING-LOADED BILLIARD CUE ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to billiard cue devices and more particularly pertains to a new billiard cue device for shooting a cue ball in billiards.

BRIEF SUMMARY OF THE INVENTION

An embodiment of the disclosure meets the needs presented above by generally comprising a tube that may be gripped while playing the game of billiards. A rod is slidably positioned in the tube and the rod is urged into a retracted position having the rod being positioned in the tube. The rod is biased into an extended position having the rod extending outwardly from the tube for striking a cue ball in the game of billiards. A light emitter is coupled to the tube to emit a beam of light outwardly therefrom for aiming during the game of billiards.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
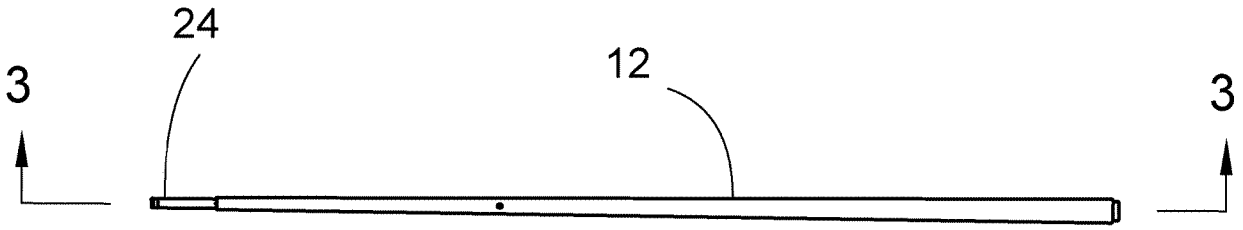
FIG. 1 is a perspective view of a spring-loaded billiard cue assembly according to an embodiment of the disclosure.
Figure 2:
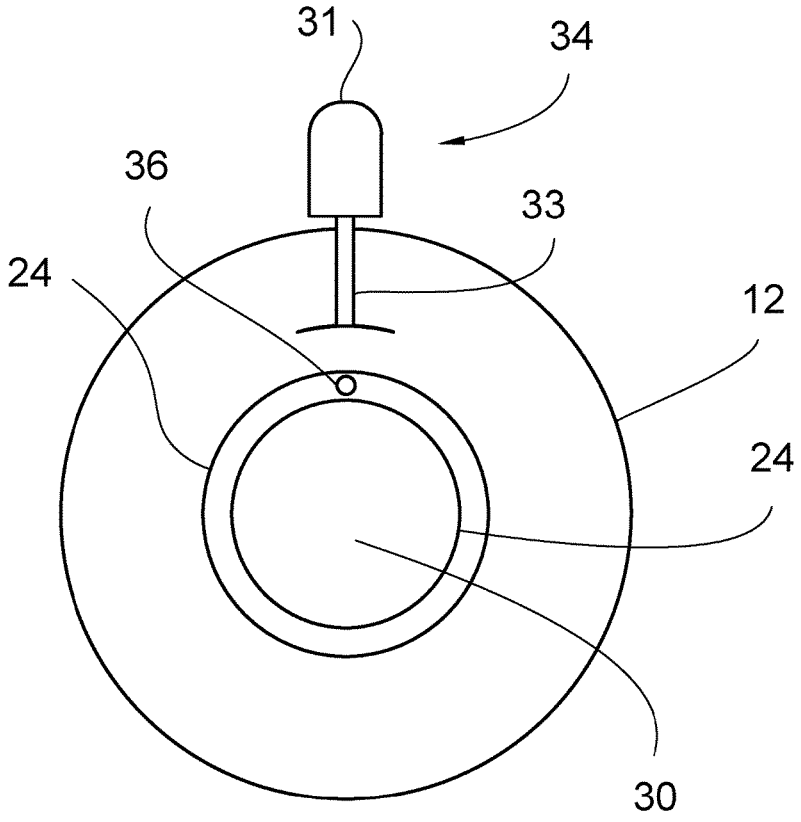
FIG. 2 is a front view of an embodiment of the disclosure.
Figure 3:
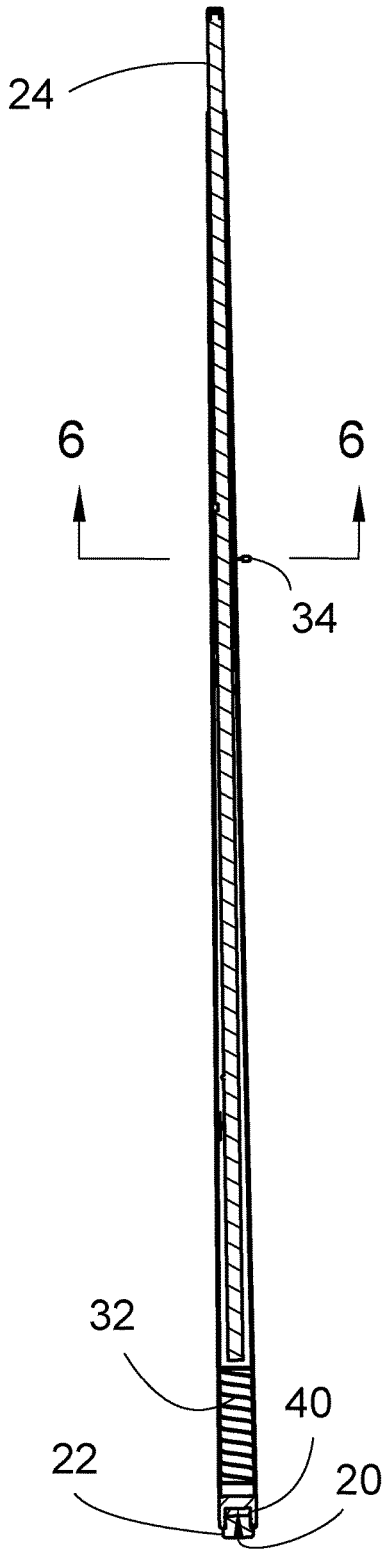
FIG. 3 is a cross sectional view taken along line 3-3 of FIG. 1 of an embodiment of the disclosure.
Figure 4:
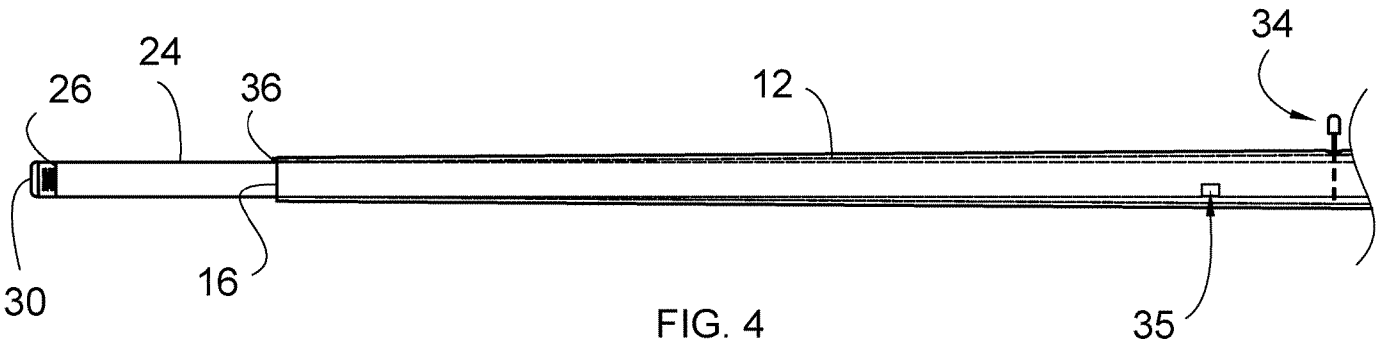
FIG. 4 is a right side phantom view of an embodiment of the disclosure.
Figure 5:
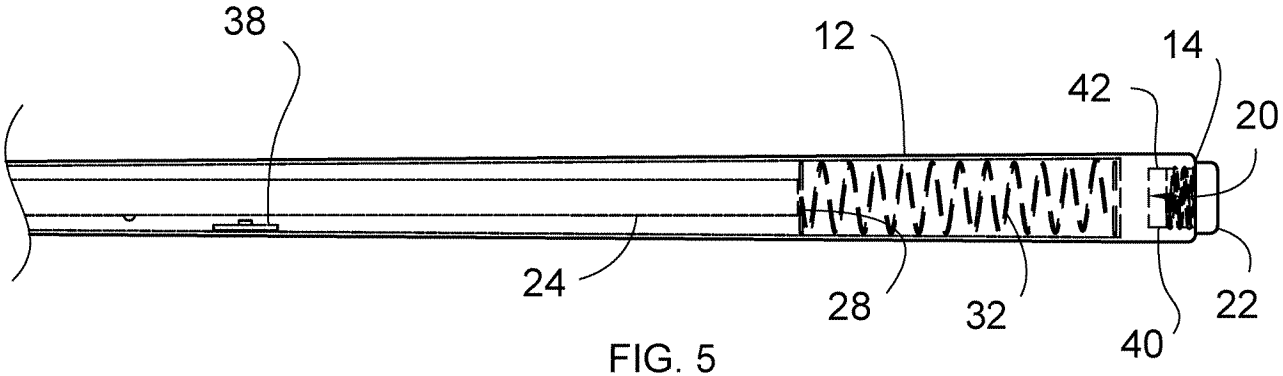
FIG. 5 is a left side phantom view of an embodiment of the disclosure.
Figure 6:
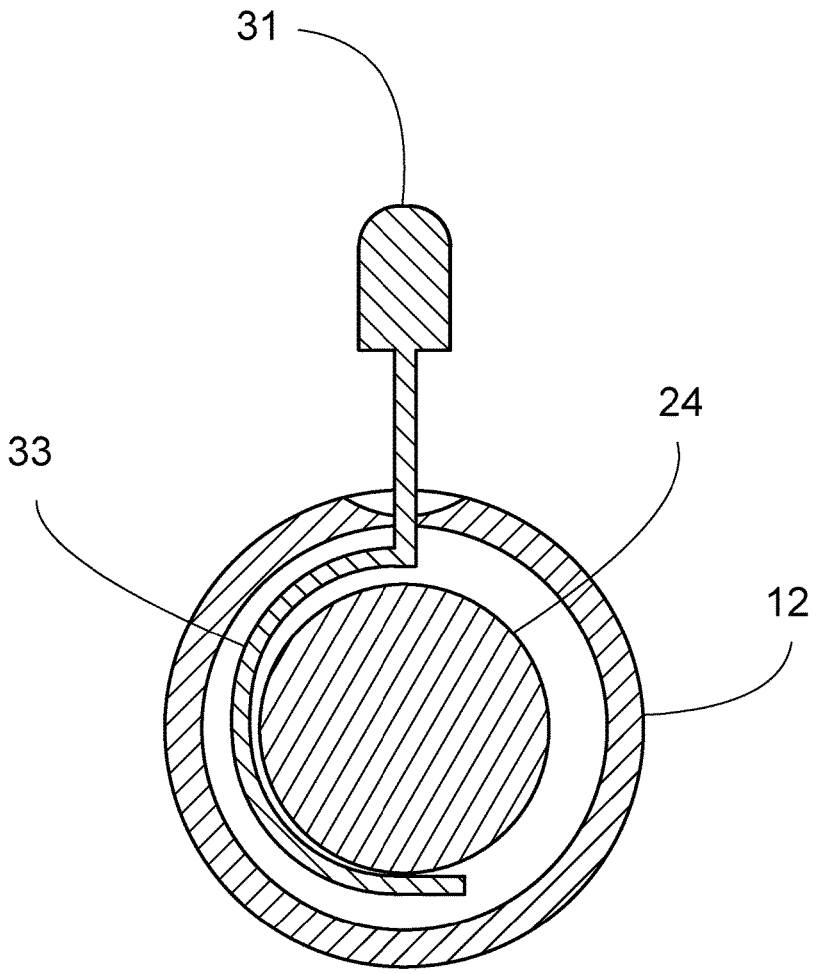
FIG. 6 is a cross-sectional view taken along line 6-6 of an embodiment of the disclosure.
Figure 7:
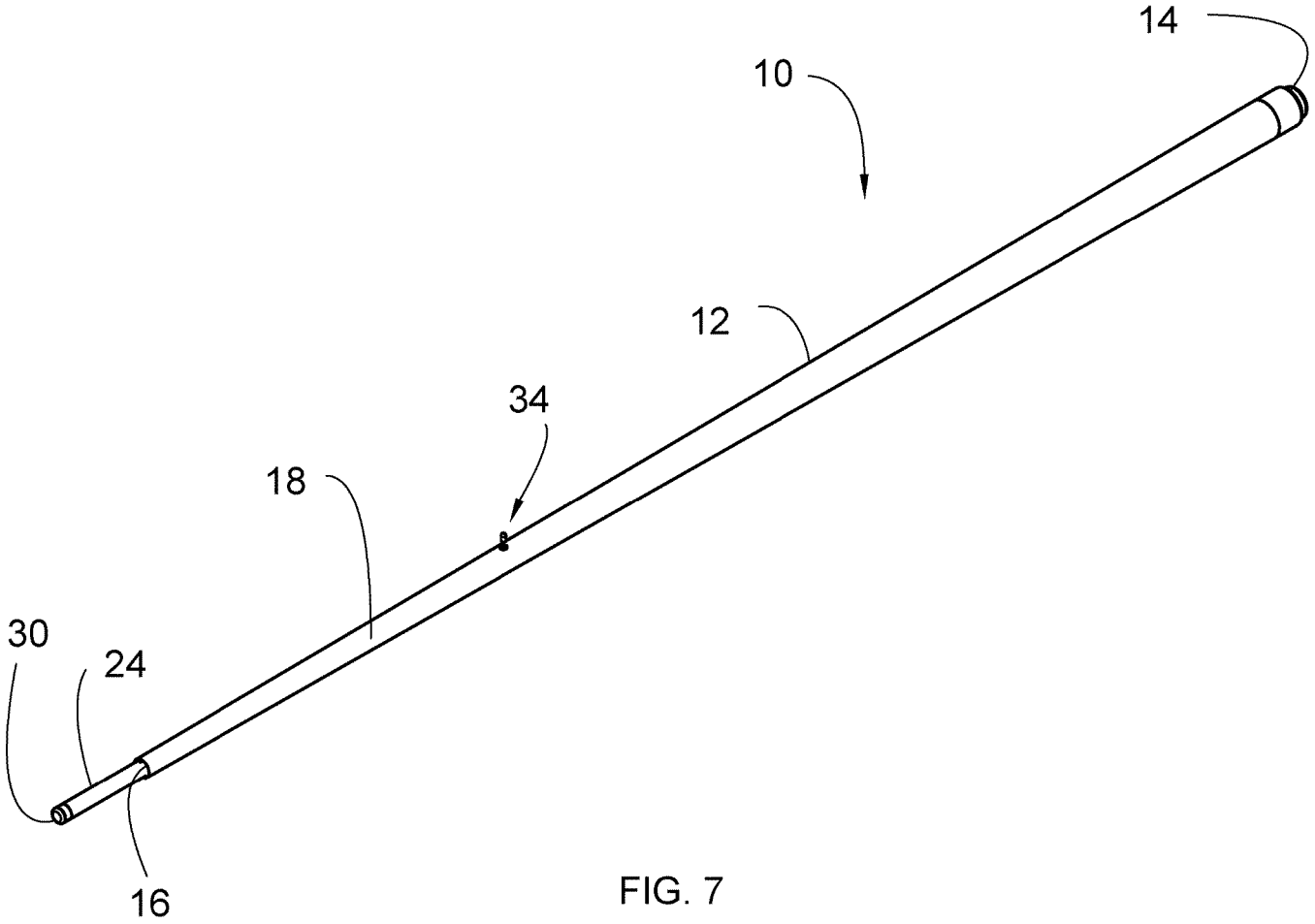
FIG. 7 is a perspective view of an embodiment of the disclosure.
Figure 8:
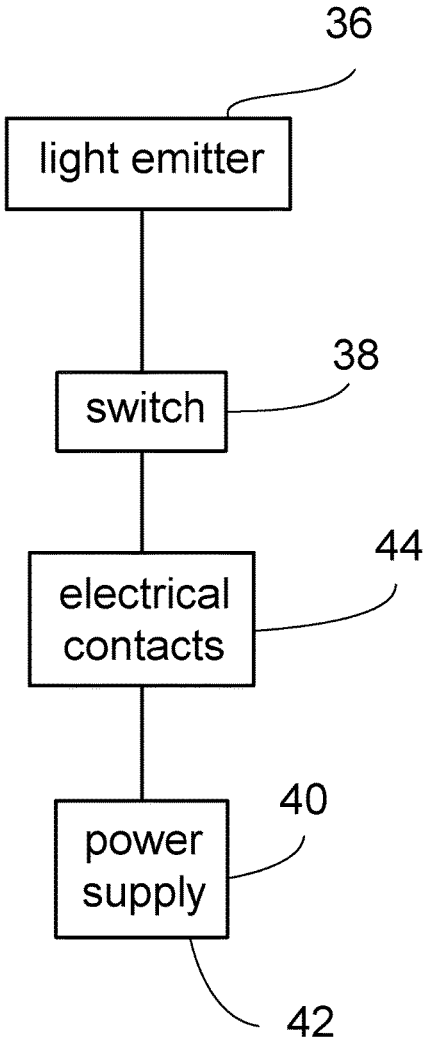
FIG. 8 is a schematic view of an embodiment of the disclosure.

With reference now to the drawings, and in particular to FIGS. 1 through 8 thereof, a new billiard cue device embodying the principles and concepts of an embodiment of the disclosure and generally designated by the reference numeral 10 will be described.

As best illustrated in FIGS. 1 through 8, the spring-loaded billiard cue assembly 10 generally comprises a tube 12 that may be gripped while playing the game of billiards. The tube 12 has a first end 14, a second end 16 and an outer wall 18 extending therebetween. The first end 14 is closed and the second end 16 is open. Additionally, the first end 14 has a well 20 extending towards the second end 16. A cap 22 is removably coupled to the first end 14 of the tube 12 to close the well 20.

A rod 24 is slidably positioned in the tube 12 and the rod 24 has a first end 26 and a second end 28. The rod 24 is selectively urged into a retracted position having the rod 24 being positioned in the tube 12. The rod 24 is biased into an extended position having the rod 24 extending outwardly from the tube 12 to strike a cue ball 29 in the game of billiards. A pad 30, such as a billiard cue pad or the like, is coupled to the first end 26 of the rod 24 to strike the cue ball 29.

A biasing member 32 to is positioned between the first end of the tube 12 and the second end of the rod 24. Thus, the biasing member 32 to biases the second end 28 of the rod 24 away from the first end 14 of the tube 12. A trigger 34 extends through the tube 12 and releasably engages the rod 24 to retain the rod 24 in the retracting position. Moreover, the trigger 34 disengages from the rod 24 when the trigger 34 is manipulated. In this way the biasing member 32 to urges the rod 24 into the extended position for striking the cue ball 29. The trigger 34 may include a knob 31 that extends outwardly through the tube 12 and finger 33 that wraps around the rod 24. The rod 24 may have a notch 35 therein and the finger 33 may engage the notch 35 when the rod 24 is urged into the retracted position. Additionally, the finger 33 may disengage the notch 35 when the knob 31 is depressed thereby facilitating the rod 24 to be biased into the retracted position.

A light emitter 36 is coupled to the tube 12 to emit a beam of light outwardly therefrom for aiming during the game of billiards. The light emitter 36 is positioned on the second end 16 of the tube 12 and the light emitter 36 may be a laser light emitter or the like. A switch 38 is positioned in the tube 12.

The switch 38 is electrically coupled to the light emitter 36 such that the switch 38 turns the light emitter 36 on and off. A power supply 40 is positioned within the tube 12 and the power supply 40 is electrically coupled to the switch 38. The power supply 40 comprises at least one battery 42 that is positioned in the well 20 in the tube 12 and electrical contacts 44 in the well 20 that are electrically coupled to the switch 38. In this way the power supply 40 is in electrical communication with the switch 38 and the light emitter 36 when the power supply is positioned in the well 20.

In use, the rod 24 is urged into the tube 12 and the trigger 34 engages the rod 24 to retain the rod 24 in the retracted position. Moreover, the rod 24 engages the switch 38 to turn the light emitter 36 on. The tube 12 is gripped and manipulated for playing the game of billiards. The light emitter 36 emits the beam of light to assist with aiming the tube 12 and point the rod 24 at the cue ball 29. The trigger 34 is manipulated to disengage the rod 24 thereby facilitating the biasing member 32 to urge the rod 24 into the extended position. Thus, the pad 30 on the rod 24 strikes the cue ball 29 thereby facilitating a person with limited skill in billiards to successfully strike the cue ball 29.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A spring-loaded billiard cue assembly being configured to automatically shoot a cue ball in billiards, said assembly comprising:

a tube being configured to be gripped while playing the game of billiards, said tube having a first end, a second end and an outer wall extending therebetween, said first end being closed, said second end being open, said first end having a well extending towards said second end;

a rod being slidably positioned in said tube, said rod being urged to be into a retracted position having said rod being positioned in said tube, said rod being biased into an extended position having said rod extending outwardly from said tube wherein said rod is configured to strike a cue ball in the game of billiards;

a light emitter being coupled to said tube wherein said light emitter is configured to emit a beam of light outwardly therefrom for aiming during the game of billiards; and a switch being coupled to said tube, said switch being electrically coupled to said light emitter such that said switch turns said light emitter on and off, said rod engaging said switch when said rod is positioned in said retracted position to turn said light emitter on.

2. The assembly according to claim 1, further comprising a cap being removably coupled to said first end of said tube to close said well.

3. The assembly according to claim 1, further comprising a pad being coupled to a first end of said rod wherein said pad is configured to strike the cue ball.

4. The assembly according to claim 1, further comprising a biasing member being positioned within said tube, said biasing member being positioned between said first end of said tube and a second end of said rod such that said biasing member biases said rod into said extended position.

5. The assembly according to claim 4, further comprising a trigger extending through said tube, said trigger releasably engaging said rod to retain said rod in said retracted position, said trigger disengaging from said rod when said trigger is manipulated such that said rod is biased into said extended position for striking the cue ball.

6. The assembly according to claim 1, wherein said rod disengages said switch when said rod is biased into said extended position to turn said light emitter off.

7. The assembly according to claim 6, further comprising a power supply being positioned within said tube, said power supply being electrically coupled to said switch, said power supply comprising at least one battery being positioned in said well in said tube.

8. A spring-loaded billiard cue assembly being configured to automatically shoot a cue ball in billiards, said assembly comprising:

a tube being configured to be gripped while playing the game of billiards, said tube having a first end, a second end and an outer wall extending therebetween, said first end being closed, said second end being open, said first end having a well extending towards said second end;

a cap being removably coupled to said first end of said tube to close said well;

a rod being slidably positioned in said tube, said rod having a first end and a second end, said rod being urged to be into a retracted position having said rod being positioned in said tube, said rod being biased into an extended position having said rod extending outwardly from said tube wherein said rod is configured to strike a cue ball in the game of billiards;

a pad being coupled to said first end of said rod wherein said pad is configured to strike the cue ball;

a biasing member being positioned within said tube, said biasing member being positioned between said first end of said tube and said second end of said rod such that said biasing member biases said second end of said rod away from said first end of said tube;

a trigger extending through said tube, said trigger releasably engaging said rod to retain said rod in said retracted position, said trigger disengaging from said rod when said trigger is manipulated such that said rod is biased into said extended position for striking the cue ball;

a light emitter being coupled to said tube wherein said light emitter is configured to emit a beam of light outwardly therefrom for aiming during the game of billiards, said light emitter being positioned on said second end of said tube;

a switch being positioned in said tube, said switch being electrically coupled to said light emitter such that said switch turns said light emitter on and off, said rod engaging said switch when said rod is positioned in said retracted position to turn said light emitter on, said rod disengaging said switch when said rod is biased into said extended position to turn said light emitter off; and a power supply being positioned within said tube, said power supply being electrically coupled to said switch, said power supply comprising at least one battery being positioned in said well in said tube.

* * * * *